US005642774A

United States Patent [19]

Christenson

[11] Patent Number: 5,642,774

[45] Date of Patent: Jul. 1, 1997

[54] HEAT EXCHANGER MOUNTING SYSTEM

[75] Inventor: Jeffrey J. Christenson, Juneau, Wis.

[73] Assignee: Touchstone, Inc., Jackson, Tenn.

[21] Appl. No.: 658,483

[22] Filed: Jun. 5, 1996

[51] Int. Cl.[6] ..... F28F 7/00

[52] U.S. Cl. ..... 165/82; 165/149

[58] Field of Search ..... 165/81, 82, 149

[56] References Cited

U.S. PATENT DOCUMENTS

| | | | |
|---|---|---|---|
| 1,834,001 | 12/1931 | Modine | 165/82 |
| 2,090,345 | 8/1937 | Coy . | |
| 2,932,489 | 4/1960 | Young . | |
| 3,165,151 | 1/1965 | Astrup et al. . | |
| 3,627,035 | 12/1971 | Astrup . | |
| 3,982,587 | 9/1976 | Tramontini . | |
| 4,140,177 | 2/1979 | Ivie, Sr. . | |
| 4,230,176 | 10/1980 | Crews . | |
| 4,465,126 | 8/1984 | Winterer . | |
| 4,619,313 | 10/1986 | Rhodes et al. . | |
| 4,899,543 | 2/1990 | Romanelli et al. . | |

*Primary Examiner*—Leonard R. Leo
*Attorney, Agent, or Firm*—Head, Johnson & Kachigian

[57] ABSTRACT

A system for mounting a side frame to a heat exchanger is provided in which the heat exchanger has a header plate and the side frame, a radial extending flange that lies parallel and adjacent to the header with aligned openings in the header and side frame flange. For each of the aligned openings, a spacer that is used has a tubular portion at one end and an enlarged diameter flange at the other. A bolt extends through the aligned openings and through the spacer. A nut on the bolt secures the spacer to the header. A tubular elastomeric washer is received on the spacer tubular portion and is compressed between the spacer radial flange and the side flange. Changes in length of the heat exchanger are permitted without changing the length of the side frame by compression of the elastomeric washer.

4 Claims, 2 Drawing Sheets

HEAT EXCHANGER MOUNTING SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

A. Field of the Invention

The invention relates to a mounting system for a heat exchanger of the type employing side frames used for supporting the heat exchanger, the side frames being attached to header plates at opposed ends of the heat exchanger including an arrangement wherein changes in length of the heat exchanger are accepted by the side frame attachment assembly.

By "heat exchanger" is meant a cooling unit, frequently referred to as a radiator, as used for cooling fluids, such for cooling engine cooling fluids as used on cars, trucks and stationary engines. A heat exchanger or radiator typically has a core that is formed of tubes, which may be either flat or round and which span the distance between a pair of header plates to which the opposed ends of the tubes are bonded. The core, including the tubes, header plates and fins that are typically placed perpendicular to the tubes, must be supported and for this purpose structural side frames are typically employed.

The tubes norm ally employed in heat exchangers are typically made of brass which has one coefficient of expansion while the side frames are usually made of high quality steel which have a different coefficient of expansion. Therefore, some means is required for compensating for the different rates of expansion of the core in the side frames. For background material relating to heat exchanger frame systems, reference can be had to U.S. Pat. No. 4,619,313 entitled "Radiator Frame Unit", issued Oct. 28, 1986. This United States patent is incorporated herein by reference.

For additional background material relating to heat exchangers and means for mounting heat exchangers, the following United States patents are relevant:

| U.S. Pat. No. | INVENTOR | TITLE |
|---|---|---|
| 2,090,345 | Coy | Heat Exchanger |
| 2,932,489 | Young | Trussed Radiator Core-Unit |
| 3,165,151 | Astrup et al | Heat-Transfer Trussed-Radiator |
| 3,627,035 | Astrup | Junction Plates For Multiple Heat Exchanger Units |
| 3,982,587 | Tramontini | Vehicular Radiator Assembly |
| 4,140,177 | Ivie, Sr. | Protective Grid and Structural Support For A Radiator |
| 4,230,176 | Crews | Floating Radiator Tank Top |
| 4,465,126 | Winterer | Heat Exchanger Arrangement, Especially For Radiators For Motor Vehicles |
| 4,619,313 | Rhodes et al | Radiator Frame Unit |
| 4,899,543 | Romanelli et al | Pre-Tensioned Shape Memory Actuator |

BRIEF SUMMARY OF THE INVENTION

This invention is concerned with a heat exchanger assembly supported by side frames including means to accommodate the thermal expansion of the heat exchanger core relative to the side frames. The heat exchanger core is formed as an assembly of closely spaced apart, parallel tubes each having an upper and a lower end. The upper ends are attached to an upper header plate and the lower ends to a lower header plate. Thus, the header plates are supported in spaced apart and paralleled relationship to each other by the tubes.

Each of the headers has openings therethrough that sealably accept the ends of the tubes. An upper tank having a circumferential horizontally extending flange is positioned adjacent to the upper header so that the upper ends of the tubes communicate with the interior of the upper tank. A gasket is positioned between the upper tank flange and the upper header. In like manner, a lower tank having a flange is positioned adjacent the lower header so that the lower ends of the tubes communicate with the interior of the lower tank. A gasket between lower tank and the header to prevent fluid leakage.

First and second side frames are employed for supporting the heat exchanger in relation to the equipment with which it is used. If the heat exchanger is a radiator utilized on mobile equipment such as truck, bus, train, etc., the side frame supports the radiator with respect to the vehicle frame. If the heat exchanger is used with a stationary engine, the side frame supports the heat exchanger in position with respect to the engine, usually mounted on a structure that is permanently situated.

Each of the side frames has an upper and a lower end, each end having a horizontally extending flange. Each side frame is positioned so that the upper flange is adjacent a lower surface of the upper header and the lower flange is adjacent the upper surface of the lower header.

Aligned openings are formed in the tank flanges, the headers and the side frame flanges to receive bolts by which the headers and the tanks are secured to and supported by the side frames. The aligned openings are such that the opening in the side frame flange is larger in diameter than the opening through the header and through the tank flange.

A bolt extends through each of the aligned openings. A spacer is received on each of the bolts, each spacer having a tubular portion with an inner end that extends through the opening in the side frame flange to engage the header. The spacer further has an enlarged diameter radially extending portion that is spaced from and parallel to the header.

A nut is received on each of the bolt so that the tank flange and header are held in close contact with each other.

A tubular elastomeric member is received on the spacer between the side frame upper horizontal flange and the spacer radial portion. The elastomeric member is dimensioned so that the header may be displaced relative to the side frame flange in response to elongation of the heater core by compressing the elastomeric member.

This mounting arrangement thereby allows for a variation in the spacing between the upper and lower headers due to expansion and contraction of the radiator core while the side frames maintain secure support of the heat exchanger. Putting it another way, the dimension between the side frame flanges is isolated from the dimension between the heat exchanger headers so that the side frame supports the heat exchanger while allowing for expansion and contraction of the heater core.

A better understanding of the invention will be obtained from the following s description of the preferred embodiments and claims, taken in conjunction with the attached drawings.

DESCRIPTION OF THE DRAWINGS

FIG. 1 shows attachment means for securing the side frames to the headers in such a way as to permit expansion of the heat exchanger core.

DETAILED DESCRIPTION OF THE PREFERRED EMBODIMENTS

Figure 1:
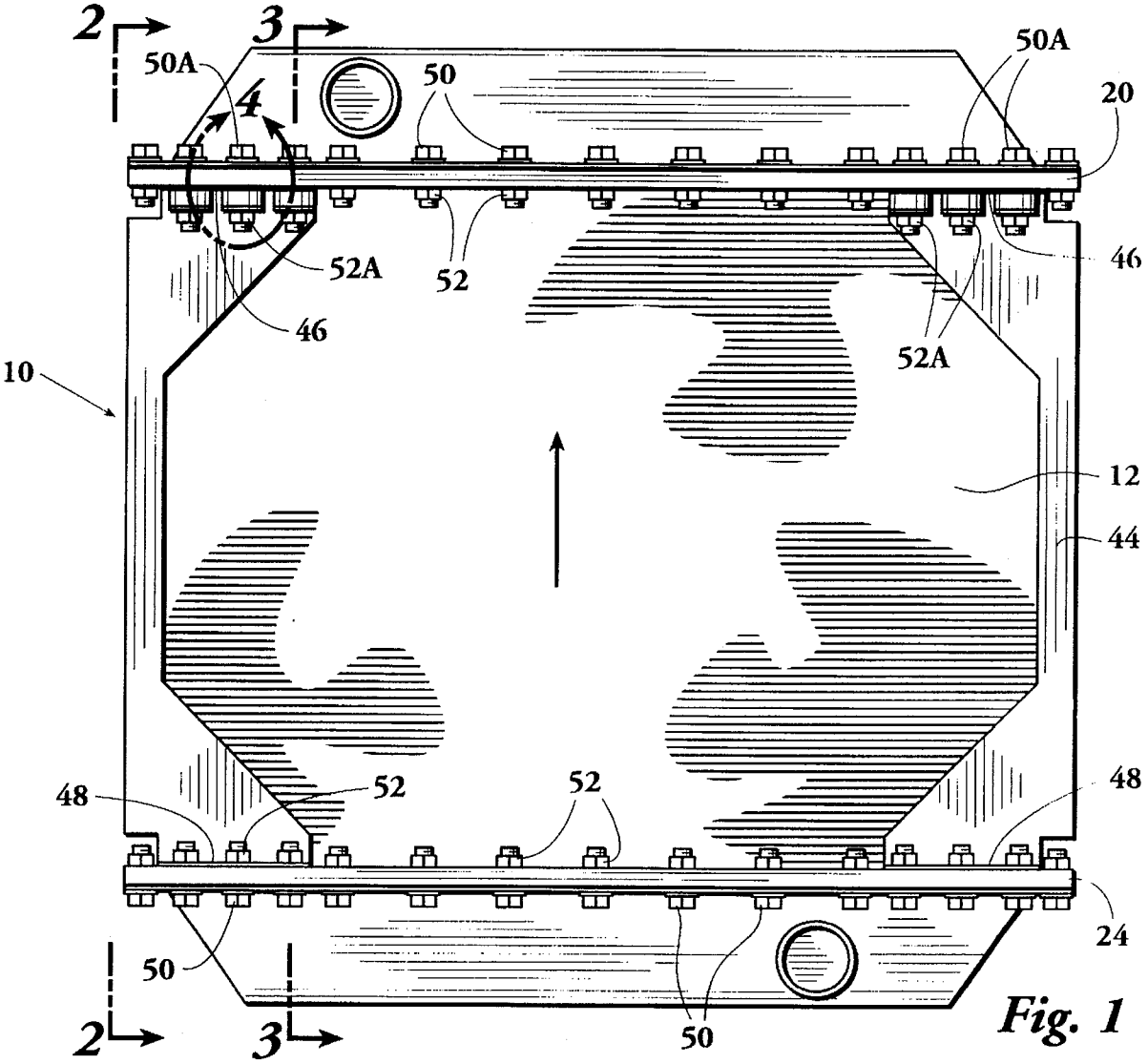
FIG. 1 is an elevational view of a heat exchanger showing a heat exchanger core with upper and lower headers, with upper and lower tanks and with opposed side frames by which the heat exchanger is supported.
Figure 2:
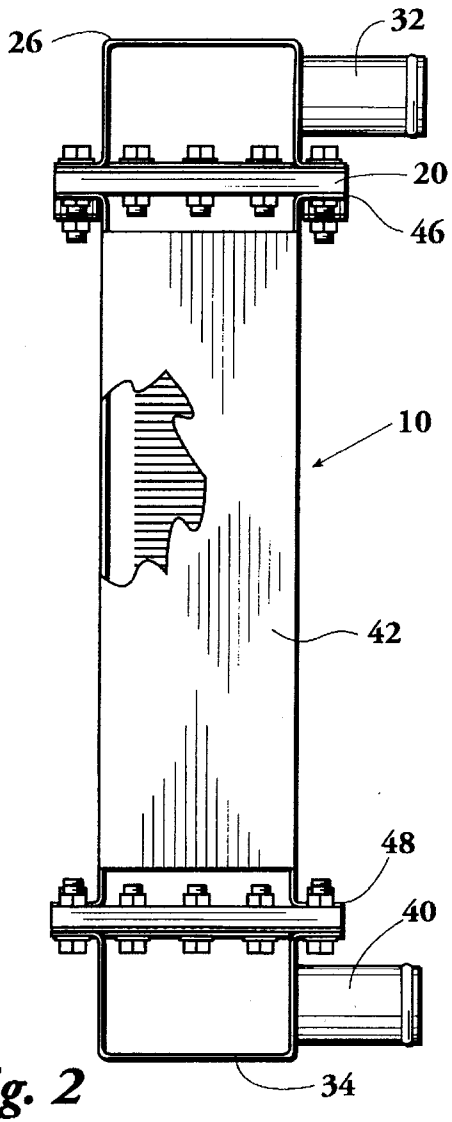
FIG. 2 is an elevational side view of the heat exchanger of Figure I as taken along the line 2—2 of FIG. 1.
Figure 3:
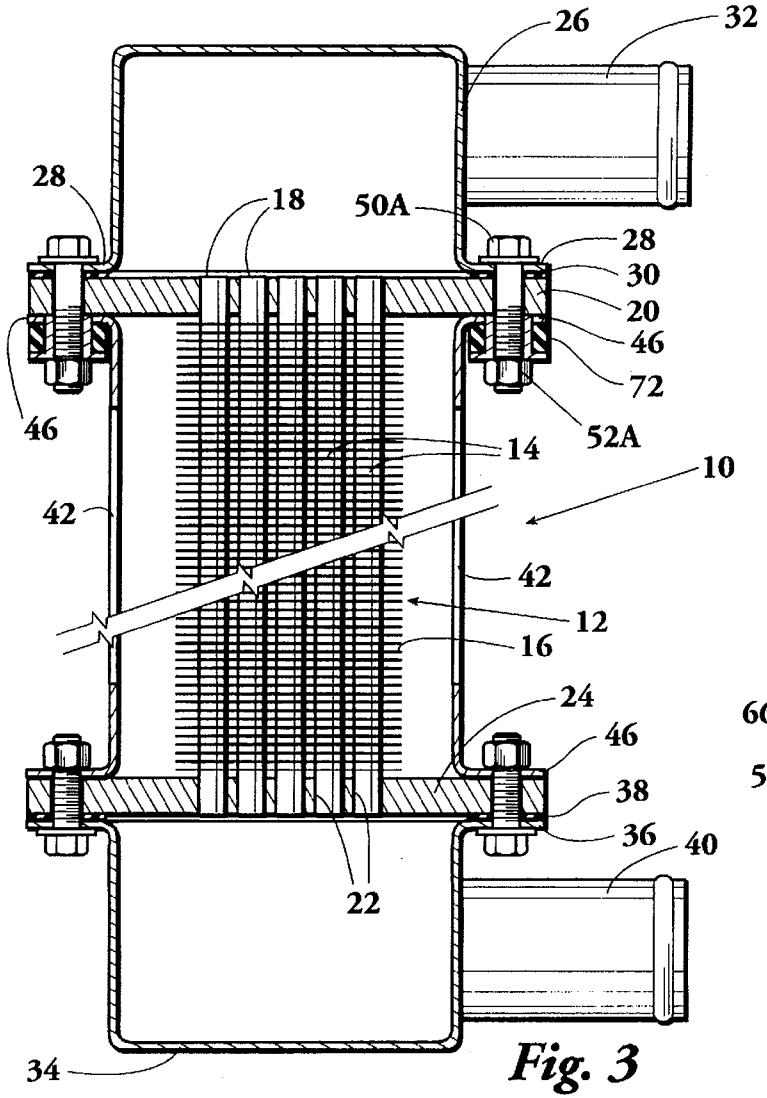
FIG. 3 is an enlarged, fragmentary, cross-sectional view of the heat exchanger, as taken along the lines 3—3 of FIG. 1.

Referring to the drawings and first to FIGS. 1, 2 and 3, a heat exchanger is indicated generally by the numeral 10. A heat exchanger, particularly when used to cool an engine are usually called a "radiator". "Heat exchanger" and "radiator" are used interchangeably in this document. Heat exchanger 10 has a typical core 12 which, as shown in FIG. 3, is made up of closely spaced parallel tubes 14 which, in the illustrated arrangement are shown as being vertical with closely spaced horizontal fins 16. The use of tubes and fins is standard technology in radiator construction and has been for many years. The upper ends of tubes 14 are individually received in openings 18 in upper header plate 20. Header plate 20 is the structural member that serves to receive and seal the upper ends of tubes 14. Tubes 14 may be soldered or otherwise sealably secured to header plate 20.

In like manner, the lower ends of tubes 14 are received in openings 22 in lower header 24. Headers 22 and 24 are described as upper and lower to distinguish them, however, this is not to imply that the invention is limited to a radiator that is vertically mounted as it applies to a radiator irrespective of the orientation and in many instances, a radiator is positioned so that the core 12 is horizontal. "Upper" and "lower" are used herein merely to differentiate portions of the header system and for simplicity of description and not to limit actual orientation of devices that employ the principles of the invention.

Upper tank 26 has a circumferential integral flange 28 that lies parallel and adjacent to upper header 20. Positioned between flange 28 and upper header 20 is a circumferential gasket 30 form in g a sealed relationship between the interior of upper tank 26 and the interior of tubes 14. Upper tank 26 is shown with a tubular outlet 32 suitable for attachment of a hose (not shown) by which fluid can be conducted to or away from the radiator.

In like manner, lower tank 34 has a circumferential integral flange 36 that lies adjacent the lower surface of lower header 24. Gasket 38 is positioned between lower tank flange 36 and lower header 24 to provide closed communication between the interior of lower tank 34 and the interior of tubes 14. A tubular outlet 40 communicates with lower tank 34 and is adaptable to receive a hose (not shown), it being understood that the means of fluid communication with upper and lower tanks 26 and 34 are by example only and are not relevant to the invention.

The heat exchanger described up to this point is conventional but illustrates the problem to which this invention relates. It can be seen that when the fluid within the heat exchanger is cold, tubes 14 will thermally contract and that when the fluid within the heat exchanger increases in temperature, tubes 14, being of metal, will expand and therefore upper header 20 will tend to be displaced relative to lower header 24. For simplicity of description it will be presumed that lower header 24 is stationary and upper header 20 is allowed to move with respect to the lower header although this is not intended to be a limitation of the invention but merely to simplify the description of the invention.

The problem that exists in the industry is to provide a frame to support the heat exchanger system that will accommodate the thermal expansion of the heat exchanger, that is, the thermally induced change in spacing between the lower and upper headers of the heat exchanger.

To support the heat exchanger, side frames are used, that is, a first side frame 42 and a second side frame 44. The side frames are made of strong metal, such as steel, and can be of various shapes. Each of the side frames has an integral upper flange portion 46 and a lower flange 48. Upper flange 46 of each of side frames is juxtaposed to the lower surface of upper header 20 and the lower flange 48 of each of the side frames is juxtaposed to the upper surface of lower flange 24. Headers 20 and 24, tank flanges 28 and 36, and side frames 42 and 44 all have spaced apart aligned openings each of which receives a bolt 50A secured by a nut 52A. The upper and lower tanks 26 and 34 with gaskets 30 and 38 and headers 20 and 24 are bolted together in all areas where there is no side frame flange by bolts 50 and nuts 52. In the illustrated arrangement the heat exchanger is arranged so that the side frames are supported directly to lower header 24 so that, as illustrated in FIGS. 1 and 3, the lower flange 48 of each of the side frames 42 and 44 is secured by bolts 52 to header 24. At the upper end of the heat exchanger, as shown specifically in FIG. 1, the bolts that secures the upper flange 46 of each of side frames 42 and 44 is arranged differently than the bolts 50 with nuts 52 which do not encompass a side frame flange.

Figure 4:
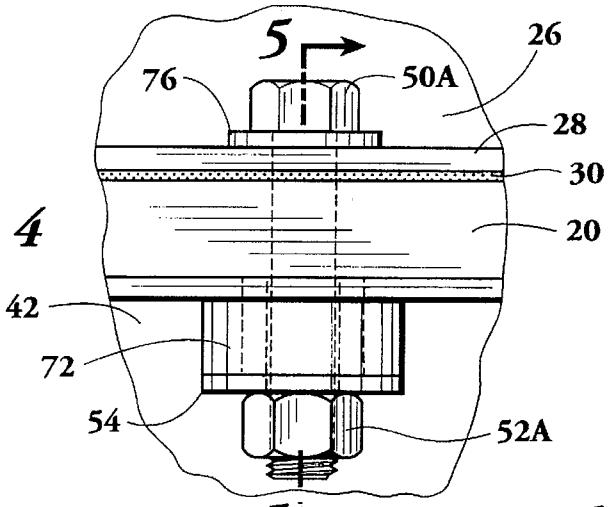
FIG. 4 is an elevational fragmentary view of a portion of the heat exchanger showing an external view of the attachment device that permits expansion of the heat exchanger core.
Figure 6:
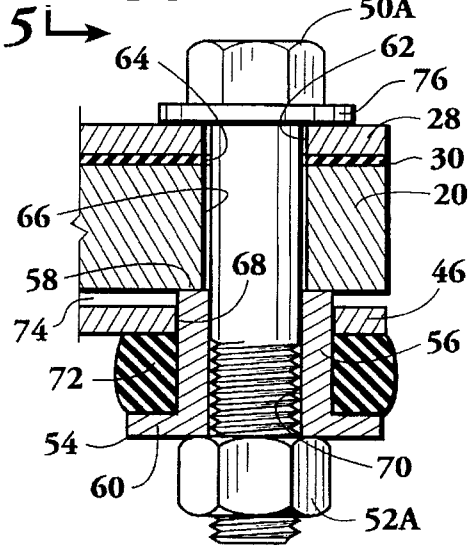
FIG. 6 is a cross-sectional view as in FIG. 5 showing a relationship of the components when the heat exchanger core has thermally expanded.
Figure 5:
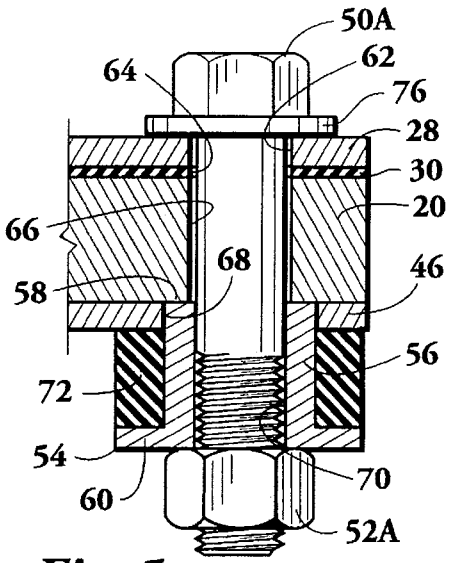
FIG. 5 is a cross-sectional view of the attachment device as taken along the line 5—5 of FIG. 4.

The arrangement for supporting the upper ends of the side frames 42 and 44 relative to upper header 20 is illustrated in FIGS. 3 through 6. Where the side frame upper flange 46 is juxtaposed to upper header 20, a spacer 54 is employed as best illustrated in FIGS. 4 and 5. Spacer 54 has an integral tubular portion 56 with an inner end 58 that engages the lower surface of header 20. Spacer 54 has, at the opposite end thereof, an integral enlarged diameter flange portion 60 that is spaced from and parallel to header 20.

As seen in FIG. 5, upper tank flange 28 has an opening 62, gasket 30 has an opening 64, header 20 has an opening 66 and upper side frame flange 46 has an opening 68, the openings all being aligned. Opening 68 is larger in diameter than openings 62, 64 and 66 so as to receive spacer tubular portion 56. Positioned within the aligned openings 62, 64, 66 and 68 as well as opening 70 in spacer 54, is a bolt 50A. Nut 52A secures together tank flange 28, gasket 30, header 20 and spacer 54, that is, these elements are permanently secured by nut 52A and held in immovable contact with respect to each other. Opening 68 in side frame flange 46 slidably receives spacer tubular portion 56 so that the side frame flange 46 can move with respect to spacer 54 and therefore with respect to header 20.

Positioned between spacer flange 56 and side frame flange 46 is an elastomeric washer 72.

FIGS. 3, 4 and 5 show the heat exchanger system wherein the heat exchanger has fluid in it that is cold or at least that is not sufficiently warm to cause an elongation of tubes 14 so that headers 20 and 24 are spaced apart as they would occur in the normal coolest environment and with coolest liquid to which the heat exchanger would normally be subjected. In this arrangement, the side frame upper flanges 46 are in contact with upper header 20 as illustrated, however, nevertheless, elastomeric washer 72 is under slight compression.

When conditions change so that the radiator core becomes warm, especially as compared with the side frame flanges, tubes 14 tend to expand and move upper header 20 upwardly relative to lower header 24. The use of spacers 54 permit the upper header to move with respect to the lower header without changing the dimensions of side frames 42 and 44. This is illustrated best in FIG. 6 wherein upper header 20 is shown displaced upwardly compared to header 20 in FIG. 5, thereby causing a slight space 74 between side frame upper flange 46 and the lower surface of upper header 20. This causes, as illustrated, compression of elastomeric washer 72. In this way, the elastomeric washer 72 maintains compression of the fitting between the side frame upper flanges 46 and upper header 20 while allowing slight movement of the upper header with respect to the side frame upper flanges.

These figures show use of a washer 76 between the head of bolt 50A and the upper tank flange 28. A washer could equally as well be employed between nut 52A and spacer 54 without changing the function of these elements.

The invention has been described wherein the heat exchanger is vertical and wherein the side frames 42 and 44 are securely affixed to the lower header 24 while upper header 20 is free to float within a limited range relative to the side frame upper flanges 46. This is by example only as the system could be reversed or by the use of spacers 54 and elastomeric washers 72, the side frame lower flanges could be mounted to permit limited movement of the lower header.

The system described has the advantage that spacers 54 allow displacement of the side frame flanges with respect to the upper header but in a way wherein this displacement occurs in only one direction since otherwise the spacer tubular portion accurately guides the movement between the header and the side frames so that the heat exchanger is always accurately supported by the side frames relative to any ancillary equipment such as cooling fans or the like.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A heat exchanger mounting system having means to accommodate thermal expansion comprising:

a heat exchanger core formed as an assembly of a plurality of closely spaced apart, paralleled tubes having upper and lower ends and an upper and a lower header, each header having openings therethrough that sealably accept the ends of the tubes so that the headers are paralleled to each other and spaced apart by the length of the tubes, each header having an inner surface and an outer surface, the heat exchanger core having opposed sides;

an upper tank having a circumferential horizontally extending flange;

a lower tank having a circumferential horizontally extending flange;

a gasket positioned between said upper tank flange and said upper header;

a first and a second side frame, each having an upper and a lower end and each having a horizontally extending flange at each end thereof, the side frames being positioned adjacent said opposed sides of said heat exchanger core with said side frame flanges juxtaposed to said upper and lower headers; said upper and lower tank flanges, said upper and lower headers, said side frame flanges and said gasket spaced apart aligned openings therethrough, the openings in said side frame flanges being of greater diameter than said openings in said header;

a bolt extending through each of said aligned openings, each bolt having a threaded portion at one end;

a spacer received on each of said bolts, each spacer having a tubular portion having an inner end that extends through said opening in said side frame upper end flange to engage said upper header, and an enlarged diameter radially extending portion that is spaced from and paralleled to said upper header;

a nut received on the threaded portion of each of said bolt whereby said header, said gasket and said tank flanges are held in close contact with each other; and a tubular elastomeric member received on said spacer between said side frame upper horizontal flange and each of said spacer radial portion whereby said upper header may be displaced relative to said side frame flange in response to elongation of said heat exchange core.

2. A means for attachment of a side frame to a heat exchanger header, the side frame having a radially extending flange, so as to permit the header to displace relative to the side frame, the side frame flange and the header having at least one aligned opening therethrough, the opening in the side frame flange being of greater diameter than the opening in the header, comprising:

a spacer including a tubular portion having an inner end and an enlarged external diameter radially extending portion at an outer end, the spacer tubular portion inner end being received within the opening in the side frame flange and in contact with said header;

a bolt extending through the opening in said header, said side frame flange and said spacer, the bolt having threads at one end portion thereof; a tubular elastomeric member received on said spacer tubular portion and compressed between said spacer radial portion and the side frame flange; and a nut received on said bolt whereby said spacer is held in contact with the header, the, side frame flange being moveable on said spacer tubular portion by compression of said elastomeric member.

3. An attachment means for securing a heat exchanger side frame to a header according to claim 2 wherein said spacer radial portion is integral with said spacer tubular portion.

4. An attachment means for securing a heat exchanger side frame to a header according to claim 2 wherein said tubular elastomeric member is dimensioned so that it is continuously in compression.

* * * * *

UNITED STATES PATENT AND TRADEMARK OFFICE

CERTIFICATE OF CORRECTION

PATENT NO. : 5,642,774

DATED : July 1, 1997

INVENTOR(S) : Jeffrey J. CHRISTENSON

It is certified that error appears in the above-indentified patent and that said Letters Patent is hereby corrected as shown below:

Column 1, line 33, delete "norm ally" and substitute --normally-- therefor;

Column 2, line 65, delete the "s";

Column 3, line 10, delete "I" and substitute --1-- therefore;

Column 6, line 24, after ";" create a new element paragraph beginning with "said upper and lower";

Column 6, line 26, after "gasket" insert --having--;

Column 6, line 62, after ";" create a new element paragraph beginning with "a tubular elastomeric"; and Signed and Sealed this Fourth Day of November, 1997

*Attest:*

*Attesting Officer*

Bruce Lehman

BRUCE LEHMAN

*Commissioner of Patents and Trademarks*